US005586694A

United States Patent [19]

Breidenbach et al.

[11] Patent Number: 5,586,694

[45] Date of Patent: Dec. 24, 1996

[54] PERFUME APPLICATOR WITH REPLACEABLE CARTRIDGES

[75] Inventors: Diane Breidenbach; Laurence Mille, both of Smithtown, N.Y.

[73] Assignee: Fragrance Systems International, Inc., Smithtown, N.Y.

[21] Appl. No.: 394,031

[22] Filed: Feb. 24, 1995

Related U.S. Application Data

[63] Continuation-in-part of Ser. No. 356,918, Dec. 14, 1994, Pat. No. 5,526,960.

[51] Int. Cl.[6] ..... B67D 5/06

[52] U.S. Cl. ..... 222/183; 222/321.7; 222/325

[58] Field of Search ..... 222/156, 183, 222/321.7, 321.9, 325, 402.1, 402.13; 401/119, 132, 134, 209, 213, 214

[56] References Cited

U.S. PATENT DOCUMENTS

| | | | |
|---|---|---|---|
| 1,670,458 | 5/1928 | Le Boeuf . | |
| 2,122,580 | 7/1938 | Morris | 401/213 |
| 2,637,466 | 5/1953 | Wright | 222/183 |
| 2,888,173 | 5/1959 | Wolcott | 222/183 |
| 2,998,165 | 8/1961 | De Elorza | 222/183 |
| 3,236,418 | 2/1966 | Dalle et al. | 222/325 |
| 4,221,494 | 9/1980 | Kachur | 401/213 |
| 4,620,811 | 11/1986 | Kageyama | 401/65 |
| 4,676,408 | 6/1987 | Speitel | 222/183 |
| 4,723,860 | 2/1988 | Giblin et al. | 401/208 |
| 4,955,567 | 9/1990 | Longhurst | 222/156 |
| 4,979,840 | 12/1990 | Madaus et al. | 401/202 |
| 4,993,860 | 2/1991 | Sommer | 401/214 |
| 5,056,949 | 10/1991 | Petrillo | 401/214 |
| 5,065,907 | 11/1991 | Allen | 222/325 |
| 5,277,510 | 1/1994 | Okamoto et al. | 410/214 |
| 5,332,325 | 7/1994 | Crosnier et al. | 410/119 |

*Primary Examiner*—Andres Kashnikow
*Assistant Examiner*—Philippe Derakshani
*Attorney, Agent, or Firm*—Alfred M. Walker

[57] ABSTRACT

A perfume dispenser is provided with clear replaceable refill cartridge. The perfume applicator includes a metal or plastic barrel, screw on cap and disposable replaceable refill cartridge. The refill cartridge acts as the case of the unit and liquid perfume is dispensed from a snap-in spring loaded applicator, such as a roll-on applicator or an atomizer spray applicator. The disposable refill cartridge screws into the base of the barrel and a clear plug portion of refill cartridge allows viewing of the perfume level to determine when the unit is empty. The replaceable perfume cartridge preferably includes a threaded neck portion with a roller ball applicator portion therein, wherein the threaded neck portion is closed by a threaded metal cap. The replaceable perfume cartridge also preferably includes a transparent base end to provide an indication of the amount of perfume left in the cartridge, wherein further the transparent base portion is adjacent to a threaded base collar which engages a reciprocal threaded interior end of a plastic sleeve within the metal exterior barrel.

10 Claims, 6 Drawing Sheets

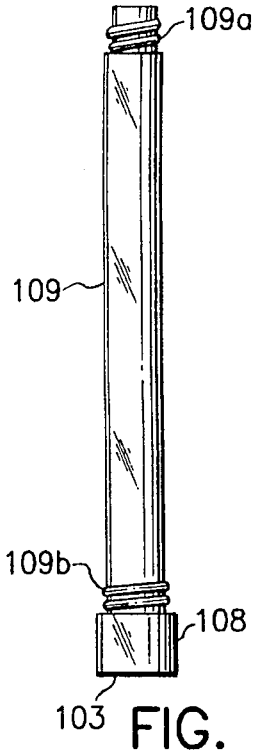
FIG. 16
FIG. 17
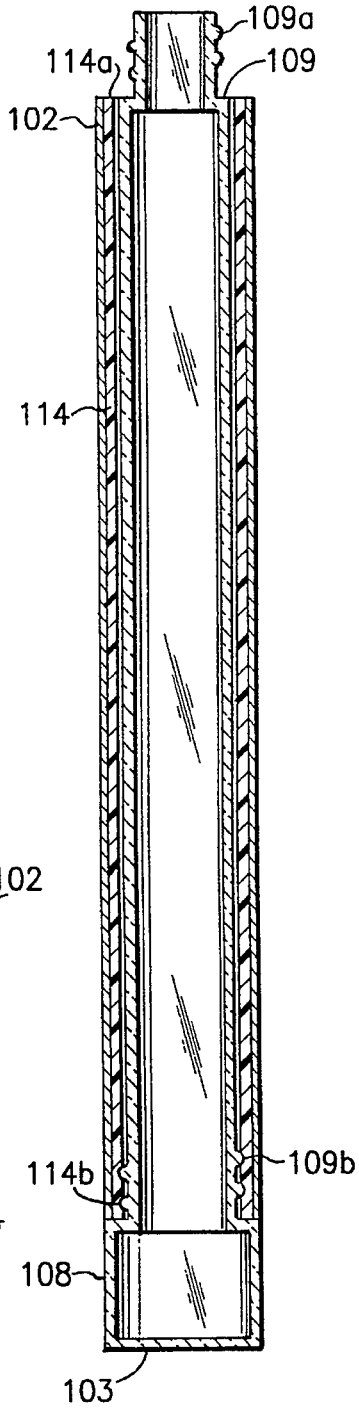
FIG. 19
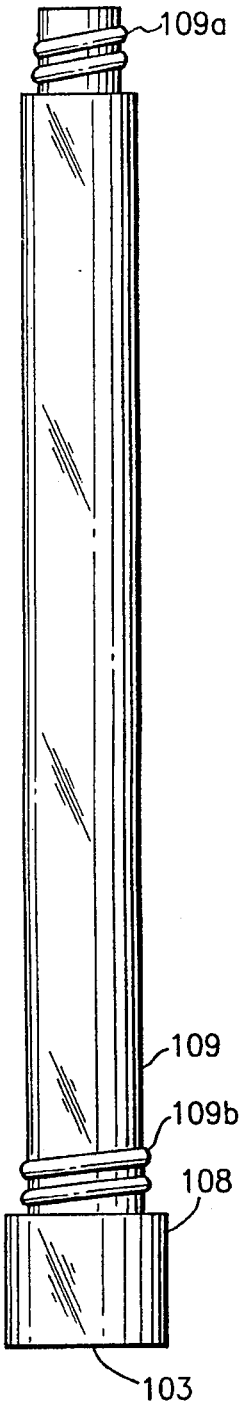
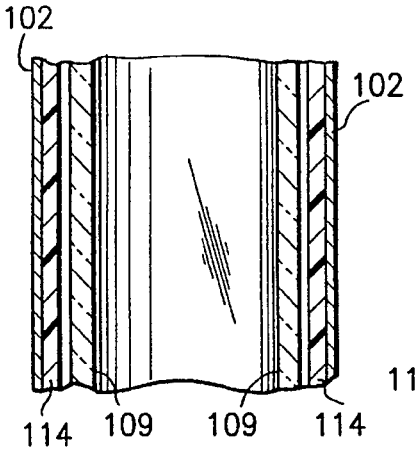
FIG. 18

PERFUME APPLICATOR WITH REPLACEABLE CARTRIDGES

This application is a continuation-in-part of application Ser. No. 08/356,918, filed Dec. 14, 1994, now U.S. Pat. No. 5,526,960.

FIELD OF THE INVENTION

The present invention relates to a cosmetic applicator, more particularly, to a refillable perfume dispenser with a conventional spring loaded applicator, which dispenser is refilled with a replaceable leakproof cartridge. The perfume dispenser utilizes the spring loaded outlet end, which may be an atomizer spray head, or a roller ball applicator head, which includes a roller ball which seals itself when the roller ball is withdrawn away from the skin of the user. In a preferred embodiment, the replaceable perfume cartridge includes a threaded neck portion with a roller ball applicator portion therein, wherein the threaded neck portion is closed by a threaded metal cap. The replaceable perfume cartridge also preferably includes a transparent base end to provide an indication of the amount of perfume left in the cartridge, wherein further the transparent base portion is adjacent to a threaded base collar which engages a reciprocal threaded interior end of a plastic sleeve within the metal exterior barrel.

BACKGROUND OF THE INVENTION

Prior art perfume dispensers exist in the form of disposable, single use pen-shaped perfume dispensers, such as saturated felt-type fillers with pointed, nib points.

Moreover, other prior art perfume dispensers have roll-on dispensing balls, which only work with undesirable thick, pasty lipstick-type of perfumes, because the circumferential edge around the roller ball leaks too much perfume, due to its liquidity in liquid form.

It is also known to provide liquid dispensers which utilize a spring loaded roller ball, which seals itself when the roller ball is withdrawn away from object upon which the liquid, such as writing or printing ink, is to be dispensed. Such roller ball applicators are manufactured by Dab-o-matic, Inc. of Mount Vernon, N.Y. However, because of the volatility of liquid perfume, sealing such a dispenser for perfume is difficult, which can result in leakage of the liquid perfume from the dispenser without proper sealing measures being taken.

The prior art patents include U.S. Pat. No. 1,670,458 of LeBoeuf for a perfume dispenser, U.S. Pat. No. 2,122,580 of Morris for a perfume applicator, U.S. Pat. No. 4,221,494 of Kachur for a roll-on applicator, U.S. Pat. No. 4,620,811 of Kageyama for a mechanical pencil with a roller ball, U.S. Pat. No. 4,723,860 of Giblin for a oval shaped roller dispenser for cosmetics, U.S. Pat. No. 4,979,840 of Madaus for a fountain pen, U.S. Pat. No. 4,993,860 of Sommer for an applying device, U.S. Pat. No. 5,056,949 of Petrillo for a correction fluid device, and U.S. Pat. No. 5,277,510 of Okamoto for a spring based applicator.

The LeBoeuf '458 and Morris '580 patents generally disclose a spring loaded liquid perfume roll on dispenser, with a refillable liquid perfume cartridge within an outer case. However, these cartridges are not disposable, and do not also function as a detachably attachable base for the dispenser.

Kachur '494 describes a spring loaded ball which may be used in a roll on applicator for a liquid. Giblin '860 discloses a spring loaded roll on applicator with an oval, as opposed to spherical, ball for antiperspirants.

Madaus '840 patent, is directed to a fountain pen which includes a transparent visible portion in the outer container for visually observing whether the supply of ink is running low.

However, a disadvantage in Madaus '840 is that the transparent visible portion is not integral with a replaceable perfume cartridge, which also functions as a base for the dispenser.

Sommer '860, Petrillo '949 and Okamato '510 describe spring loaded ink pens and Kageyama '811 describes a mechanical pencil.

The disadvantages of the prior art roller ball dispensers is that the liquid retention barrel must be painstakingly filled for re-use, via a funnel and pour spout, or with an eyedropper.

In addition, a disadvantage of the Mataus fountain pen is that the transparent visible portion is part of the fountain pen barrel, and is not part of a replaceable cartridge.

OBJECTS OF THE INVENTION

In order to improve over the disadvantages of the prior art, it is an object of the present invention to provide a liquid perfume dispenser with a disposable, replaceable perfume cartridge, with a visible window base portion built into the perfume cartridge.

It is another object to provide a perfume dispenser assembly with an outer container, a spring loaded ball applicator, located at an outlet end of the outer container, wherein a spring means exerts pressure on the ball of the ball applicator to urge the ball to a closed position of the outlet end of the outer container for preventing spillage of perfume therethrough.

It is yet another object to provide a perfume dispenser with a replaceable liquid cartridge which acts as a base for the dispenser.

It is yet another object to provide a liquid reservoir cartridge which is insertable within an outer container.

It is a further object to provide a liquid perfume dispenser with a transparent window portion integral with the replaceable base cartridge for indicating the presence or absence of liquid perfume within the reservoir cartridge.

It is yet another object to provide a liquid perfume dispenser which includes an inner sleeve within an outer container, for sealing the liquid perfume from spillage within the outer container.

It is yet another object to provide a valve seat upon which a spring loaded ball applicator rests.

It is a further object to provide a perfume dispenser with a removable cylindrical dispenser perfume vial.

It is yet another object to provide a disposable perfume reservoir cartridge with a removable stopper for sealing the liquid perfume within the reservoir, wherein the stopper is removable to permit fluid communication between the perfume reservoir and the spring loaded ball applicator.

It is another object to provide a perfume dispenser assembly with an outer container, a spring loaded atomizer spray applicator, located at an outlet end of the outer container, wherein a spring means exerts pressure on the spray head of the ball applicator to urge the spray head to a closed position of the outlet end of the outer container for preventing spillage of perfume therethrough.

It is yet another object to provide a replaceable perfume cartridge which includes a threaded neck portion with a roller ball applicator portion therein, wherein the threaded neck portion is closed by a threaded metal cap.

It is yet another object to provide a replaceable perfume cartridge which also includes transparent base end to provide an indication of the amount of perfume left in the cartridge, wherein further the transparent base portion is adjacent to a threaded base collar which engages a reciprocal threaded interior end of a plastic sleeve within the plastic sleeve within the metal exterior barrel.

It is also an object to provide a dispenser with a roller ball applicator which permits a user to apply perfume linearly in a line of liquid perfume upon parts of the human body, such as a neck, a forearm or a wrist.

It is a further object to provide a perfume dispenser having the dimensions of the exterior shape of the dispensing portions of the dispenser, which assumes the dimensions and spatial relations of a hand writing instrument, such as a fountain pen or a felt tip pen, so that the dispenser is thin enough and long enough for the user to manually handle in a manner equivalent to handling a writing instrument, yet thick enough to manually grab.

It is yet another object to improve over the disadvantages of the prior art perfume dispensers.

SUMMARY OF THE INVENTION

In keeping with these objects and others which may become apparent, the present invention provides a liquid perfume dispenser assembly with a disposable liquid perfume cartridge. The dispenser has an outer container having an open base end and an outlet end, with a conventional spring loaded ball applicator, or an atomizer spray applicator, located at said outlet end of the outer container.

In the roller ball embodiment, a spring means exerts pressure on the ball of the ball applicator to urge the ball to a closed position for preventing spillage of perfume therethrough. The spring loaded ball is responsive to opening the outlet end upon the application of force against the ball.

Moreover, the liquid perfume is provided in a disposable cartridge which acts as a base for the container. The base includes extending therefrom, a liquid reservoir cartridge, which is insertable within an outer container, such as a cylinder.

The base of the disposable perfume cartridge includes a transparent window portion integral with the base, to indicate the presence or absence of liquid perfume within said reservoir cartridge.

The disposable liquid dispensing cartridge base portion is threadably engagable with the outer container, which has the roller ball applicator at the discharge end. An inner sleeve is provided within the outer container for sealing the liquid perfume from spillage within the outer container. The inner sleeve also acts as a valve seat upon which the spring loaded ball applicator rests.

The replaceable disposable reservoir cartridge may be a removable cylindrical vial which is structurally integral with the base, which threadably engages the outer container of the dispenser.

Prior to installation within the outer container, the disposable replaceable reservoir cartridge has a removable stopper which seals the liquid perfume within the reservoir, and is removable to permit fluid communication between the reservoir cartridge and the spring loaded ball applicator when the cartridge is inserted for use within the container.

In a preferred embodiment, the replaceable perfume cartridge includes a threaded neck portion with a roller ball applicator portion therein, wherein the threaded neck portion is closed by a threaded metal cap. The replaceable perfume cartridge also includes a transparent base end to provide an indication of the amount of perfume left in the cartridge, wherein further the transparent base portion is adjacent to a threaded base collar which engages a reciprocal threaded interior end of a plastic sleeve within the metal exterior barrel.

DESCRIPTION OF THE DRAWINGS

The present invention can best be described in conjunction with the drawings, in which:

FIG. 16 is a side elevational view of the cartridge as in FIG. 13 without the roller ball.

FIG. 17 is a side sectional view of the cartridge as in FIG. 16.

FIG. 18 is a closeup side sectional view of a portion of the cartridge as in FIG. 16.

FIG. 19 is a closeup side view of the cartridge as in FIG. 16.

DETAILED DESCRIPTION OF THE DRAWINGS

Figure 1:
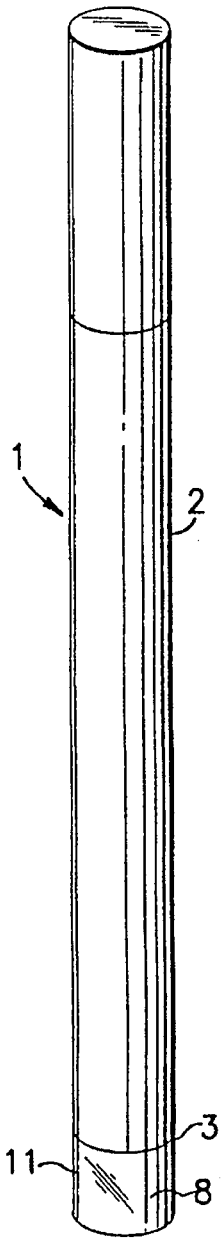
FIG. 1 is a perspective view of the perfume dispenser of the present invention.
Figure 2:
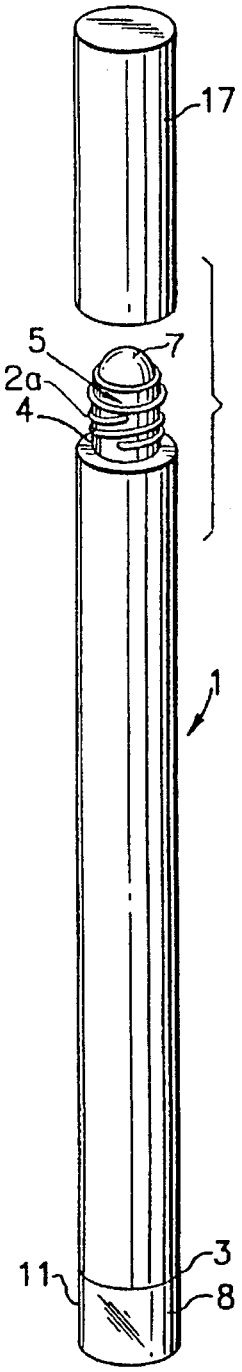
FIG. 2 is an exploded perspective view of the perfume dispenser as in FIG. 1, shown in an open position.

As shown in FIGS. 1–8, in one roller ball applicator embodiment of the present invention, a liquid perfume dispenser assembly 1 includes an outer container 2 having an open base end 3 and an outlet end 4. A spring loaded ball applicator 5 is positioned at outlet end 4 of outer container 2. Applicator 5 has a spring means 6, such as a coil spring, which exerts pressure on a ball 7 of ball applicator 5 to urge ball 7 to a closed position of outlet end 4 of outer container 2 to prevent spillage of liquid perfume therethrough.

Spring applicator 5 is removable from outer container 2, and outlet end 4 of outer container 2, upon the application of force against ball 7.

Disposable base 8 is detachably attachable to open base end 3 of outer container 2. Base 8 includes disposable replaceable liquid reservoir cartridge 9 extending therefrom. Disposable replaceable reservoir cartridge 9 includes a predetermined amount of liquid perfume therein. Disposable liquid reservoir cartridge 9 is insertable within outer container 2, and has a discharge end 10 opposite base 8. Discharge end 10 is in fluid communication with spring loaded ball applicator 5 at outlet end 4 of outer container 2.

Figure 1A:
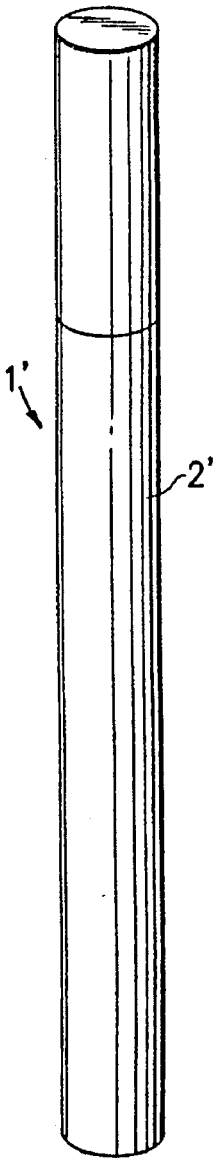
FIG. 1A is a perspective view of an alternate embodiment.
Figure 2A:
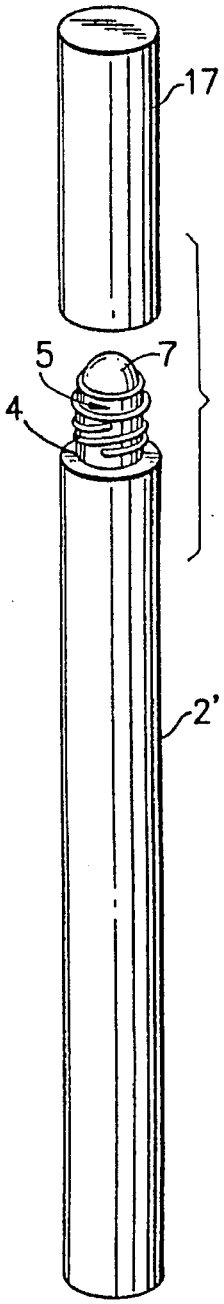
FIG. 2A is an exploded perspective view of the alternate embodiment as in FIG. 1A.
Figure 3:
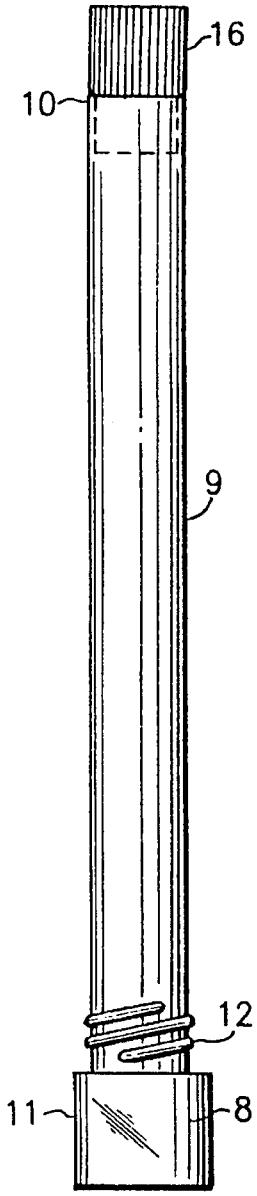
FIG. 3 is a side elevational view of the disposable, replaceable base cartridge of the present invention as in FIG. 1.
Figure 4:
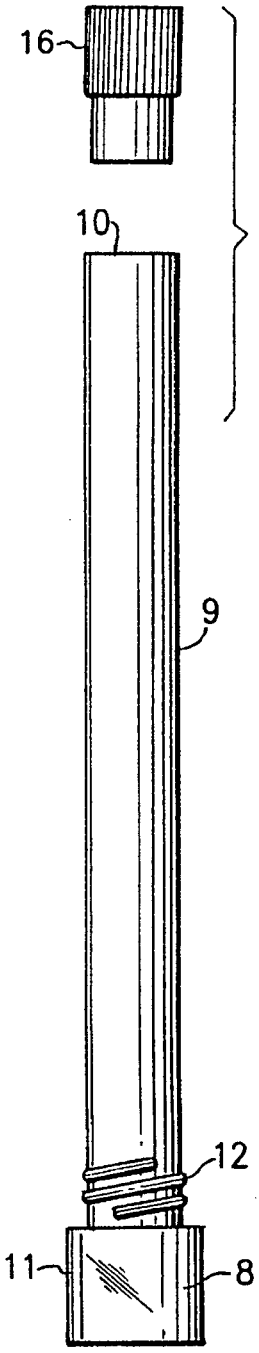
FIG. 4 is an exploded side elevational view of the disposable, replaceable base cartridge of the present invention as in FIG. 1.

In a further embodiment, as shown in FIGS. 1A and 2A, the liquid reservoir cartridge may be integral with an opaque outer barrel 2', wherein the outer barrel 2' includes the liquid perfume directly therein.

While disposable cartridge 9 may be opaque, preferably, to enable a user to see how much perfume is left in disposable cartridge 9, liquid perfume dispenser 1 preferably includes a transparent window portion 11 integral with base 8 for indicating the presence or absence of liquid perfume within disposable, replaceable reservoir cartridge 9.

Base 8 is engagable with outer container 2, by threaded portion 12, or by other means, such as snaps and detents, which threaded portion 12 is engagable with further threaded portion 13 of outer container 2.

An inner sealing sleeve 14 may be preferably provided within outer container 2, to seal the liquid perfume from spillage within outer container 2.

Inner sleeve 14 includes a top end 15 of said inner sleeve 14 which top end 15 forms a valve seat upon which spring loaded ball applicator 5 rests.

Disposable, replaceable reservoir cartridge 9 is preferably a removable cylindrical vial which is structurally integral with base 8, so that when cartridge 9 is empty, it may be easily removed from outer container 2 and replaced with a full cartridge.

Disposable, replaceable reservoir cartridge 9 further includes a removable stopper 16 which seals liquid perfume within reservoir cartridge 9. Stopper 16 is removable to permit fluid communication between reservoir cartridge 9 and spring loaded ball applicator 5, to permit liquid perfume to flow therefrom.

Liquid perfume dispenser assembly 1 is covered by removable cap 17 which cap 17 is engagable over spring loaded roller ball applicator 5. The removable cap 17, is detachably attachable to outer container 2 of liquid perfume dispenser assembly 1.

Perfume dispenser 1 is preferably 5¼" long and outer container 2 is a metal or plastic. Replaceable cartridge 9 acts as base 8 for dispenser 1. Without cartridge 9 in place, liquid would pour out.

Figure 9:
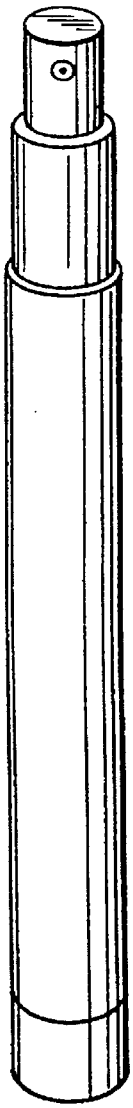
FIG. 9 is a perspective view of another embodiment of a perfume dispenser with an atomizer spray top, shown without the cap.
Figure 10:
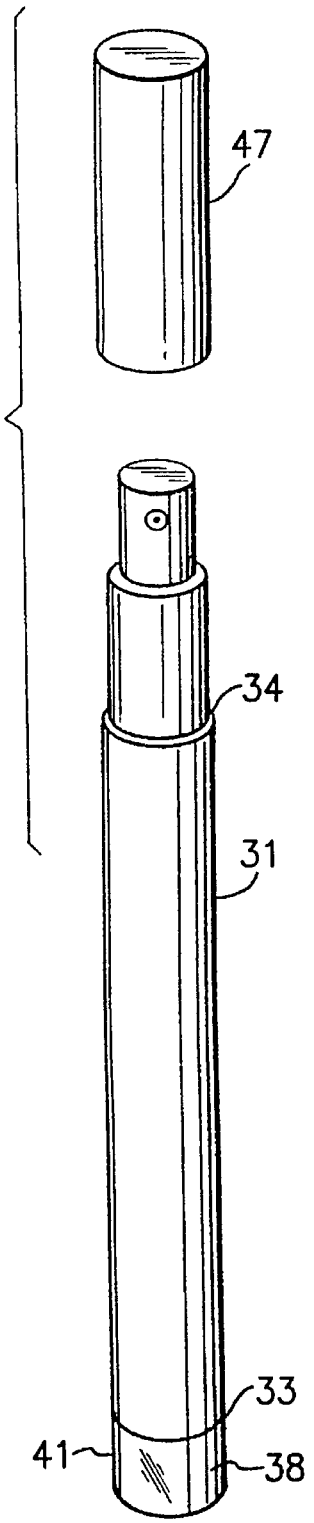
FIG. 10 is a perspective view of another embodiment of a perfume dispenser with an atomizer spray top as in FIG. 9, shown with a cap.
Figure 11:
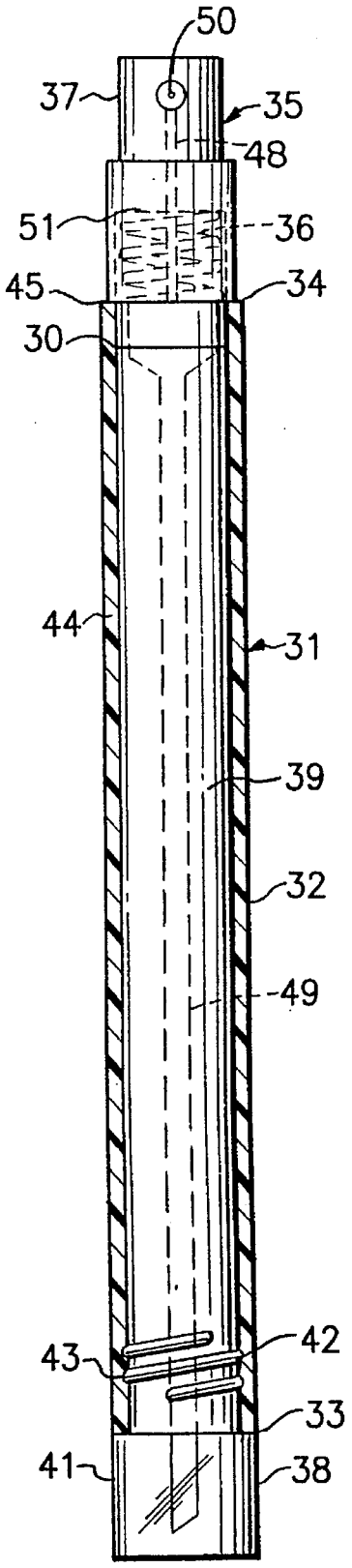
FIG. 11 is a side elevational view in partial cross section of the perfume dispenser with an atomizer spray top of the present invention as in FIG. 9.
Figure 12:
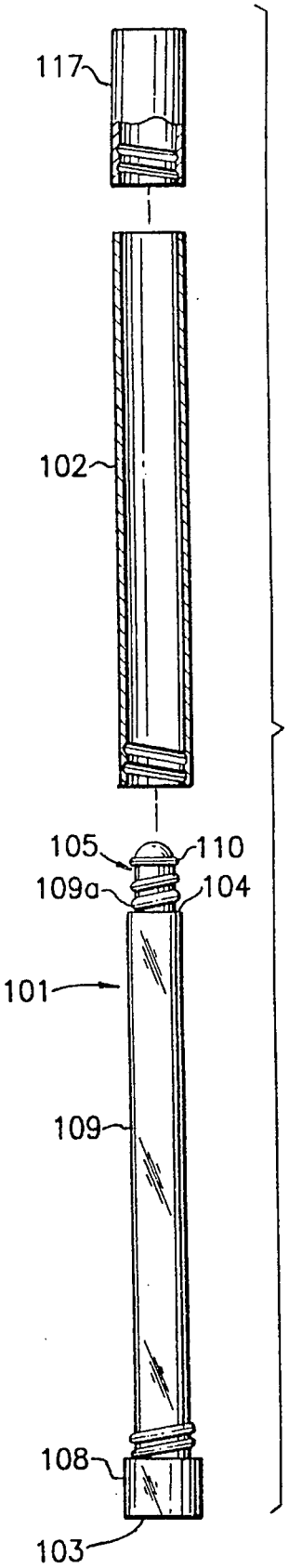
FIG. 12 is a exploded side view in partial section of an alternate embodiment for the perfume dispenser.
Figure 13:
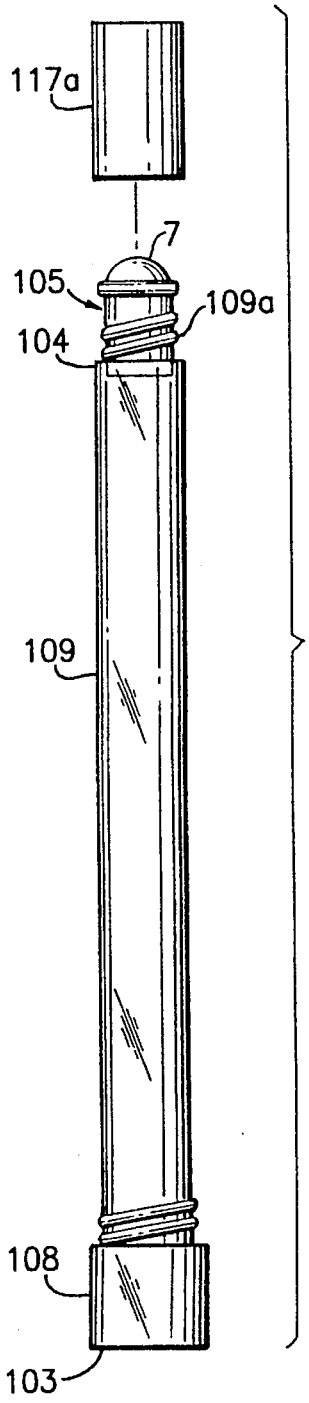
FIG. 13 is an exploded side view of the cartridge portion of the embodiment as in FIG. 12.
Figure 14:
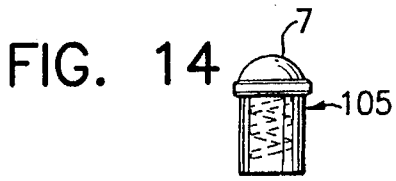
FIG. 14 is a closeup of roller ball application of embodiment as in FIG. 12.
Figure 15:
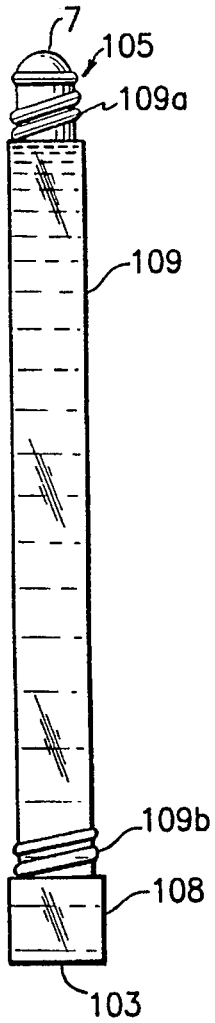
FIG. 15 is a side elevational view of cartridge as in FIG. 13, shown filled with liquid perfume.

As shown in FIGS. 9–11, another embodiment for an atomizer spray top embodiment of the present invention includes a liquid perfume dispenser assembly 31 including an outer container 32 having an open base end 33 and an outlet end 34. A spring loaded spray atomizer applicator 35 is positioned at outlet end 34 of outer container 32. Applicator 35 has a spring means 36, such as a coil spring, which exerts pressure on an atomizer spray head cap 37 of atomizer applicator 35 to urge atomizer spray head cap 37 to a closed position at outlet end 34 of outer container 32, to prevent spillage of liquid perfume therethrough. When in use, atomizer spray head cap 37 is depressed, causing depression of coil spring 36, so that upper outlet conduit 48 is in communication with lower dip tube conduit 49, to allow the flow of perfume out of exit pin hole 50 of spray atomizer applicator 35.

Atomizer spray applicator 35 is attached to outlet end 34 of outer container 32, in a tight fit, wherein the inside of spray atomizer 35 fits snugly over an extension portion 51 of outer container 32.

Disposable base 38 is detachably attachable to open base end 33 of outer container 32. Base 38 includes disposable replaceable liquid reservoir cartridge 39 extending therefrom. Disposable replaceable reservoir cartridge 39 includes a predetermined amount of liquid perfume therein. Disposable liquid reservoir cartridge 39 is insertable within outer container 32, and has a discharge end 30 opposite base 38. Discharge end 30 is in fluid communication with atomizer spray applicator 35 at outlet end 34 of outer container 32.

To enable a user to see how much perfume is left in disposable cartridge 39, liquid perfume dispenser 31 includes a transparent window portion 41 integral with base 38 for indicating the presence or absence of liquid perfume within disposable, replaceable reservoir cartridge 39.

Base 38 is engagable with outer container 32, by threaded portion 42, or by other means, such as snaps and detents, which threaded portion 42 is engagable with further threaded portion 43 of outer container 42.

An inner sealing sleeve 44 may be preferably provided within outer container 32, to seal the liquid perfume from spillage within outer container 32.

Inner sleeve 44 includes a top end 45 of said inner sleeve 44, which top end 45 forms a valve seat upon which atomizer spray applicator 35 rests.

Disposable, replaceable reservoir cartridge 39 is preferably a removable cylindrical vial which is structurally integral with base 38, so that when cartridge 39 is empty, it may be easily removed from outer container 32 and replaced with a full cartridge.

Disposable, replaceable reservoir cartridge 39 further may includes a removable stopper, such as stopper 16 which seals liquid perfume within reservoir cartridge 9 of the embodiment shown in FIGS. 1–8.

As also shown in FIGS. 9–11, liquid perfume dispenser assembly 31 is covered by removable cap 47, which cap 47 is engagable over atomizer spray applicator 35. Removable cap 47, is detachably attachable to outer container 32 of liquid perfume dispenser assembly 31.

Perfume dispenser 31 is also preferably 5¼" long and outer container 32 is a metal or plastic. Replaceable cartridge 39 acts as base 38 for dispenser 31. Without cartridge 39 in place, liquid would pour out.

Figure 5:
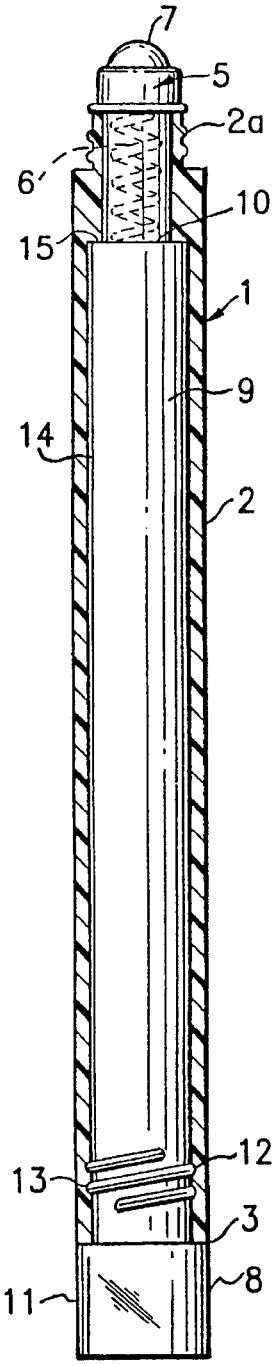
FIG. 5 is a side elevational view in partial cross section of the perfume dispenser of the present invention as in FIG. 1.
Figure 6:
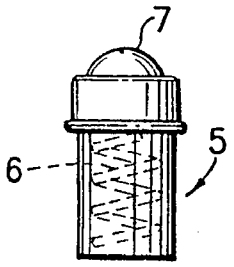
FIG. 6 is a close-up view of a spring loaded roller ball portion of the perfume dispenser as in FIG. 1.
Figure 7:
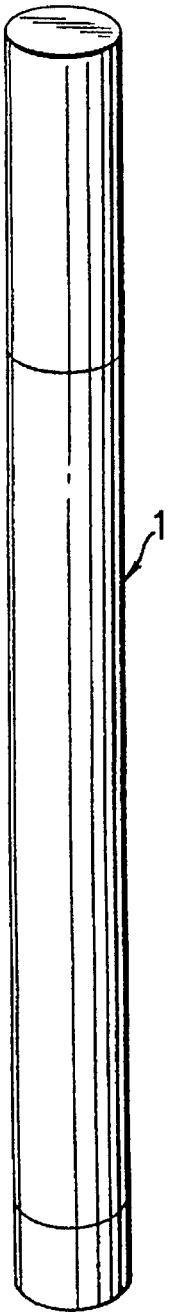
FIG. 7 is a perspective view of the perfume dispenser as in FIG. 1, shown with a cap.
Figure 8:
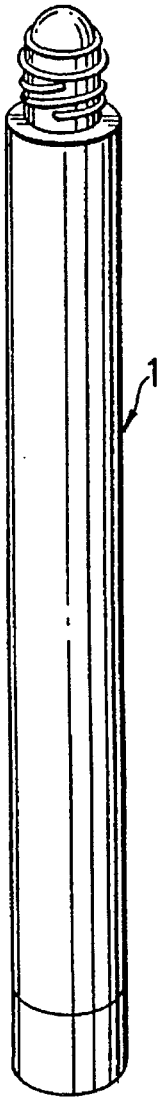
FIG. 8 is a perspective view of the perfume dispenser as in FIG. 1, shown without the cap.

As shown in FIGS. 12–20, in an alternate preferred embodiment, refillable cosmetic applicator 101, such as a perfume dispenser, includes outer barrel 102, replaceable cartridge 109 having closed base end 103, outlet end 104 and spring loaded applicator 105, such as a roller ball assembly, similar to roller ball assembly 5 shown in FIG. 5 herein, which dispenser 101 is refilled with a replaceable leakproof cartridge 109. The perfume dispenser utilizes the spring loaded outlet end, which may be an atomizer spray head, such as in FIG. 11 or a roller ball applicator head 105, as in FIG. 5, which includes a spring 6 and roller ball 7 which seals itself when the roller ball 7 is withdrawn away from the skin of the user. As shown in FIGS. 12–20, in a preferred embodiment, replaceable perfume cartridge 109 includes a threaded neck portion 109*a* with a roller ball applicator portion 5 at discharge end 110 therein, wherein the threaded neck portion 109*a* is closed by a threaded metal cap 117.

Prior to installation within barrel 102, cartridge 109 is temporarily covered by temporary cap 117*a*.

The replaceable perfume cartridge 109 also includes a transparent base end 108 to provide an indication of the amount of perfume left in the replaceable cartridge 109, wherein further the transparent base portion 108 is adjacent to a threaded base collar 109*b* which engages a reciprocal threaded interior end 114*b* of a plastic sleeve 114 within the metal exterior barrel 102. Sleeve 114 includes top end 114*a* adjacent to threaded neck end 109*a*, and threaded base end 114*b*. The width of top threaded portion 109*a* of replaceable cartridge 109 is smaller than the width of the threaded base collar 109*b* so that top threaded portion 109*a* will fit within threaded interior end 114*b* of plastic sleeve 114, when cartridge 109 is inserted within sleeve 114.

Replaceable reservoir cartridge 109 may be easily removed by unthreading metal cap 117 from the top of cartridge 109 and unthreading sleeve 114 of barrel 102 from the base of cartridge 109.

Because the roller ball applicator applies the perfume linearly in a line of liquid perfume upon parts of the human body, such as a neck, a forearm or a wrist, it is preferable that the dimensions of the exterior shape of the dispensing portions of the dispenser, namely, the linear length of the cartridge and roller ball applicator portions of the dispenser, with the cap removed, assume the dimensions and spatial relations of a writing instrument, such as a fountain pen or a felt tip pen, so that the dispenser, with the cap removed, acts as a handle means, which handle means is thin enough and long enough for the user to manually handle in a manner equivalent to handling a writing instrument, yet thick enough to manually grab.

Therefore, preferably the dimensions of the cartridge portion with the roller ball applicator portion extending therefrom, combined, is between 3½ and 6 inches, preferably between 4 and 5 inches in length and between ⅜" and ⅝" in round cross sectional diameter, preferably about ½" in diameter.

It is therefore understood that other modifications may be made to the present invention, without departing from the scope of the appended claims.

We claim:

1. A liquid perfume product dispenser assembly comprising, in combination:

a cylindrical container having an open base end and an open outlet end, a removable and replaceable liquid reservoir cartridge within said cylindrical container;

said reservoir cartridge having an open discharge end extending beyond the outlet end of said cylindrical container and a closed end extending beyond the open base end of said cylindrical container;

dispensing means removably mounted in the open discharge end of said reservoir cartridge for dispensing the contents of said cartridge and to permit the replacement of said cartridge and transfer of said dispensing means to a replacement cartridge; and cover means for enclosing the open discharge end of said cartridge and said dispensing means to form a continuous cylindrical configuration with said cylindrical container.

2. The liquid perfume product dispenser as in claim 1, further comprising a handle means to apply the liquid perfume from said dispensing means linearly in a line of the liquid perfume being spread upon parts of the human body, such as a neck, a forearm or a wrist, said handle means comprising said liquid perfume product dispenser bearing an exterior shape having dimensions and spatial symmetry of a writing instrument, such as a fountain pen or a felt tip pen, wherein when said liquid perfume product dispenser is used with said cover means removed, said liquid perfume product dispenser having a pre-determined cross sectional diameter thin enough to handle in a manner equivalent to a writing instrument and a pre-determined length long enough to handle in a manner equivalent to handling a writing instrument, and wherein said pre-determined cross sectional diameter of said liquid perfume product dispenser is thick enough to manually grab within the fingers of the hand of a user of said liquid perfume product dispenser.

3. The liquid perfume product dispenser as in claim 2, wherein the pre-determined dimensions, of said cartridge and said dispensing means combined are between 3½ and 6 inches in length and between ⅜ inch and ⅝ inch in round cross sectional diameter.

4. The liquid perfume product dispenser as in claim 2, wherein the pre-determined dimensions of said cartridge and said dispensing means combined are between 4 and 5 inches in length and about ½ inch in round cross sectional diameter.

5. The perfume product dispenser of claim 1 in which the closed end of said cartridge extending beyond the base end of said cylinder includes a transparent portion to view the contents of said cartridge.

6. The perfume product dispenser of claim 5 in which said cartridge is threadably engaged with said cylinder.

7. The perfume product dispenser of claim 1 in which said dispensing means comprises means consisting of a spring biased applicator normally sealing the open end of said cartridge and dispensing the contents of said cartridge when said applicator is pressed inwardly.

8. A liquid perfume product dispenser as in claim 6, wherein further said transparent portion is adjacent to a threaded base collar which engages a reciprocal threaded interior end of a plastic sleeve insertable within said cylindrical container.

9. The perfume product dispenser of claim 7 in which said applicator is a roller ball.

10. The perfume product dispenser of claim 1 in which said dispensing means comprises an atomizer spray head.

* * * * *